US010174960B2

(12) United States Patent
Celotta et al.

(10) Patent No.: US 10,174,960 B2
(45) Date of Patent: Jan. 8, 2019

(54) STEAM DISPERSION SYSTEM

(71) Applicant: DRI-STEEM Corporation, Eden Prairie, MN (US)

(72) Inventors: Daniel W. Celotta, Circle Pines, MN (US); Sukru Erisgen, Eden Prairie, MN (US); Cole Kennedy Farley, Long Lake, MN (US); James M. Lundgreen, Lakeville, MN (US); Todd M. Poshusta, Shakopee, MN (US)

(73) Assignee: DRI-STEEM Corporation, Eden Prairie, MN (US)

( * ) Notice: Subject to any disclaimer, the term of this patent is extended or adjusted under 35 U.S.C. 154(b) by 132 days.

(21) Appl. No.: 15/273,097

(22) Filed: Sep. 22, 2016

(65) Prior Publication Data

US 2017/0082307 A1 Mar. 23, 2017

Related U.S. Application Data

(60) Provisional application No. 62/222,538, filed on Sep. 23, 2015.

(51) Int. Cl.
*F16K 43/00* (2006.01)
*F24F 6/18* (2006.01)

(52) U.S. Cl.
CPC ..... *F24F 6/18* (2013.01)

(58) Field of Classification Search
CPC ..... F24F 6/18; Y10S 261/76
See application file for complete search history.

(56) References Cited

U.S. PATENT DOCUMENTS 903,150 A 11/1908 Braemer
1,101,902 A 6/1914 Braemer
(Continued)

FOREIGN PATENT DOCUMENTS

DE 25 29 057 2/1977
DE 19812476 10/2002
(Continued)

OTHER PUBLICATIONS

2004 ASHRAE Handbook—HVAC Systems and Equipment, pp. 20.6, 20.7, 36.2, 36.3, (4 pages total).
(Continued)

*Primary Examiner* — Reinaldo Sanchez-Medina
(74) *Attorney, Agent, or Firm* — Merchant & Gould P.C.

(57) ABSTRACT

A steam dispersion system includes a header defining a first end and a second end, a plurality of steam dispersion tubes extending upwardly from the header, a condensate drain outlet located at the first end, a hollow pipe positioned within the header, the pipe defining a length extending in a direction generally from the first end to the second end, the pipe defining a main humidification steam inlet located at the first end and a main steam outlet that is within the header. The hollow pipe is configured to receive steam flowing in from the main steam inlet toward the main steam outlet. The pipe may define a plurality of orifices along the length thereof for allowing steam flowing through the pipe to enter the header for distribution through the dispersion tubes. A steam re-direction structure directs steam flow leaving through the main steam outlet back toward the first end of the header.

13 Claims, 4 Drawing Sheets

(56) References Cited

U.S. PATENT DOCUMENTS

| | | | |
|---|---|---|---|
| 1,333,855 | A | 3/1920 | Lissauer |
| 2,963,284 | A | 12/1960 | Bradford |
| 3,096,817 | A | 7/1963 | McKenna |
| 3,215,416 | A | 11/1965 | Liben |
| 3,268,435 | A | 8/1966 | Sellin |
| 3,386,659 | A | 6/1968 | Rea |
| 3,443,559 | A | 5/1969 | Pollick |
| 3,486,697 | A | 12/1969 | Fraser |
| 3,623,547 | A | 11/1971 | Wallans |
| 3,635,210 | A | 1/1972 | Morrow |
| 3,642,201 | A | 2/1972 | Potchen |
| 3,696,861 | A | 10/1972 | Webb |
| 3,724,180 | A | 4/1973 | Morton et al. |
| 3,768,290 | A | 10/1973 | Zatell |
| 3,857,514 | A | 12/1974 | Clifton |
| 3,870,484 | A | 3/1975 | Berg |
| 3,923,483 | A | 12/1975 | Hilmer et al. |
| 3,955,909 | A | 5/1976 | Craig et al. |
| 4,040,479 | A | 8/1977 | Campbell et al. |
| RE30,077 | E | 8/1979 | Kun et al. |
| 4,257,389 | A | 3/1981 | Texidor et al. |
| 4,265,840 | A | 5/1981 | Bahler |
| 4,384,873 | A | 5/1983 | Herr |
| D269,808 | S | 7/1983 | Morton |
| 4,438,807 | A | 3/1984 | Mathur et al. |
| 4,660,630 | A | 4/1987 | Cunningham et al. |
| 4,765,058 | A | 8/1988 | Zohler |
| 4,913,856 | A | 4/1990 | Morton |
| 4,967,728 | A | 11/1990 | Dueck |
| 5,054,548 | A | 10/1991 | Zohler |
| 5,126,080 | A | 6/1992 | Morton et al. |
| 5,146,979 | A | 9/1992 | Zohler |
| 5,186,252 | A | 2/1993 | Nishizawa et al. |
| 5,277,849 | A | 1/1994 | Morton et al. |
| 5,333,682 | A | 8/1994 | Liu et al. |
| 5,372,753 | A | 12/1994 | Morton |
| 5,376,312 | A | 12/1994 | Morton et al. |
| 5,516,466 | A | 5/1996 | Schlesch et al. |
| 5,525,268 | A | 6/1996 | Reens |
| 5,543,090 | A | 8/1996 | Morton et al. |
| 5,697,430 | A | 12/1997 | Thors et al. |
| 5,860,279 | A | 1/1999 | Bronicki et al. |
| 5,942,163 | A | 8/1999 | Robinson et al. |
| 5,996,686 | A | 12/1999 | Thors et al. |
| 6,065,740 | A | 5/2000 | Morton |
| 6,092,794 | A | 7/2000 | Reens |
| 6,167,950 | B1 | 1/2001 | Gupte et al. |
| 6,227,526 | B1 | 5/2001 | Morton |
| 6,371,058 | B1 | 4/2002 | Tung |
| 6,378,562 | B1 | 4/2002 | Noone et al. |
| 6,398,196 | B1 | 6/2002 | Light et al. |
| 6,485,537 | B2 | 11/2002 | Brilmaker |
| 6,488,219 | B1 | 12/2002 | Herr |
| 6,631,856 | B2 | 10/2003 | Herr |
| 6,824,127 | B2 | 11/2004 | Park et al. |
| 6,883,597 | B2 | 4/2005 | Thors et al. |
| 6,906,296 | B2 | 6/2005 | Centanni |
| 7,048,958 | B2 | 5/2006 | de Jong et al. |
| 7,150,100 | B2 | 12/2006 | Tase et al. |
| 7,178,361 | B2 | 2/2007 | Thors et al. |
| 7,254,964 | B2 | 8/2007 | Thors et al. |
| 7,744,068 | B2 | 6/2010 | Lundgreen et al. |
| 7,980,535 | B2 | 7/2011 | Dovich et al. |
| 8,092,729 | B2 | 1/2012 | Lundgreen et al. |
| 8,505,497 | B2 | 8/2013 | Lundgreen et al. |
| 8,534,645 | B2 | 9/2013 | Lundgreen et al. |
| 2002/0089075 | A1 | 7/2002 | Light et al. |
| 2004/0026539 | A1 | 2/2004 | Herr |
| 2005/0126215 | A1 | 6/2005 | Thors et al. |
| 2005/0212152 | A1 | 9/2005 | Reens |
| 2006/0196449 | A1 | 9/2006 | Mockry et al. |
| 2008/0290533 | A1* | 11/2008 | Dovich ..... F24F 6/18 261/128 |
| 2009/0179337 | A1* | 7/2009 | Lundgreen ..... F24F 6/18 261/115 |
| 2015/0115053 | A1 | 4/2015 | Kopel et al. |

FOREIGN PATENT DOCUMENTS

| | | |
|---|---|---|
| GB | 1 444 992 | 8/1976 |
| GB | 2 019 233 A | 10/1979 |
| WO | WO 00/57112 | 9/2000 |
| WO | WO 2007/099299 A1 | 9/2007 |

OTHER PUBLICATIONS

AWT Association of Water Technologies "Objectives of Water Treatment," found at https:www.awt.org/ProfessionalID/WaterTreatmentOverview.pdf, (undated), 3 pages.

Bernier, "Closed-Loop Ground-Coupled Heat Pump Systems," ASHRAE Journal, Sep. 2006, pp. 12-19.

Chow et al., Imclone Laboratory Renovation Project, 2007 Ashrae Student Design Competition, HVAC System Selection, Kansas State University, May 2, 2007, 38 pages.

NORTEC®, SAM-e Short Absorption Manifold, Submittal Drawings, Nov. 15, 2005, 26 pages.

ProTherm Industries, Pipe Insert Heaters, obtained Sep. 2, 2014 from www.prothermind.com/pip_insert.htm, 1 page.

Taco Radiant Made Easy Application Guide, Air Elimination from Hydronic Heating Systems, Technical Documents TD11, Dec. 1, 2004, 4 pages.

Wolverine Tube, Inc.—Product Catalog—"Enhanced Surface Tube"—[online]—downloaded Oct. 4, 2007, pp. 1-2, http://www.wlv.com/products/products/Enhanced/enhanced.htm.

Wolverine Tube, Inc.—Turbo-ELP—"ID/OD Enhanced Surface for Improved Boiling Heat Transfer"—[online]—downloaded Nov. 13, 2008, pp. 1-3, http://www.wlv.com/products/products/Enhanced/TurboELP.htm.

ZOTEFOAMS Inc., ZOTEK® F—High Performance PVDF Foams (for Buildings and Construction)—"Taking foam technology to a new level," pp. 1-2, Oct. 2009.

ZOTEFOAMS Inc., ZOTEK® F—High Performance PVDF Foams (for Aviation and Aerospace)—"Taking foam technology to a new level," pp. 1-4, Oct. 2009.

ZOTEFOAMS Inc., ZOTEK® F—High Performance PVDF Foams—"Taking foam technology to a new level," pp. 1-4, Oct. 2009.

ZOTEFOAMS Inc., ZOTEK® F—High Performance PVDF Foams (New Light Weight Materials—Inspiration for Design Innovation)—"Taking foam technology to a new level," pp. 1-6, Date Printed: Dec. 23, 2008.

* cited by examiner

STEAM DISPERSION SYSTEM

CROSS REFERENCE TO RELATED APPLICATIONS

The present application claims priority to U.S. Provisional Application No. 62/222,538, filed Sep. 23, 2015, the disclosure of which is hereby incorporated by reference in its entirety.

TECHNICAL FIELD

The principles disclosed herein relate generally to the field of steam dispersion humidification. More particularly, the disclosure relates to control and evacuation of unwanted condensate from steam dispersion systems.

BACKGROUND

Industrial buildings which use steam boilers for heating may use the boiler steam for humidification by injecting it directly into the air. A steam dispersion system panel is used to uniformly disperse the steam into an airstream within an air duct or air handling unit (AHU).

Cool air flowing across the dispersion tubes of the steam dispersion system panel causes some of the steam within the dispersion tubes to condense. This condensate is drained out of the steam dispersion system panel to prevent it from accumulating and entering the airstream with the steam.

The condensate drain of a pressurized steam dispersion panel is typically located on the end of a steam header of the panel opposite of the steam inlet. The velocity of the pressurized steam entering the header of the steam dispersion system forces the condensate to the opposite end of the header where the drain is typically located. If the drain were on the same side as the steam inlet, then unwanted condensate could accumulate in the header and enter the airstream. For this reason, condensate drains are typically located on the end opposite of the pressurized steam inlet.

However, locating the drain on the opposite end of a header from the steam inlet necessitates access to both ends of the header for installation of steam and condensate piping, thus potentially increasing the size of the AHU or reducing the active dispersion area of the panel. Installation costs may also be higher for the piping.

An external condensate drain pipe can be installed underneath the header and sloped back to the steam inlet side of the header, but this may increase cost and requires space underneath the header which may reduce the active steam dispersion area of the panel.

It is desirable for the steam inlet and condensate drain to be on the same side of the header. Access to only one side, instead of both sides, of the header is then needed for steam and condensate piping. This can reduce installation costs and utilize the AHU space more efficiently. However, unwanted accumulation of the condensate is a serious concern as noted above.

Improvements in this area are desired.

SUMMARY

The principles disclosed herein relate to improvements in piping of unwanted condensate from steam dispersion humidification systems.

The inventive principles relate to the use of an internal feature or structure within the header which re-directs the flow of the entering steam approximately 180 degrees back towards the steam inlet. The drain port can be located on the same side as the steam inlet since the condensate is pushed towards the drain by the re-directed steam flow. The condensate does not accumulate in the header or enter the airstream. The condensate drain can be located on the same side as the steam inlet while reliably draining the condensate from the header. The advantages of same-side piping are combined with effective condensate drainage from the header without the need for an external condensate drain pipe underneath the header.

The internal steam re-directing feature may include a hollow structure or a pipe through which the steam is transported towards the opposite end of the header. Orifices that penetrate the hollow structure or pipe allow some of the steam to exit to enhance uniform steam distribution within the header and control back pressure before the remaining steam is re-directed approximately 180 degrees back towards the steam inlet side of the header. The redirecting structure can include a 180-degree U-bend of the pipe, two quantity 90-degree bends of the pipe, or multiple styles of deflecting shields or deflectors provided within the header that cooperate with the pipe in re-directing the steam.

In one particular aspect, the disclosure is directed to a steam dispersion system including a steam header defining a first end and a second end, a plurality of steam dispersion tubes extending upwardly from the header, a condensate drain outlet located at the first end of the header, a hollow pipe positioned within the header, the hollow pipe defining a length extending within the header in a direction generally from the first end to the second end, the hollow pipe defining a main humidification steam inlet located at the first end of the header and a main steam outlet within the header, wherein the hollow pipe is configured to receive steam that flows in from the main steam inlet toward the main steam outlet. The hollow pipe may define a plurality of orifices along the length thereof for allowing steam that is flowing through the hollow pipe to enter the header for distribution through the steam dispersion tubes. A steam re-direction structure is configured to direct steam flow leaving through the main steam outlet back toward the first end of the header.

According to another aspect, the disclosure is directed to a humidification steam dispersion system comprising a steam header defining a first end, a second end, and a steam exit point for supplying humidification steam to the atmosphere, a condensate drain outlet located at the first end of the header, a hollow pipe positioned within the header, the hollow pipe defining a length extending within the header in a direction generally from the first end to the second end, the hollow pipe defining a main humidification steam inlet located at the first end of the header and a main steam outlet within the header, wherein the hollow pipe is configured to receive steam that flows in from the main steam inlet toward the main steam outlet, and a steam re-direction structure configured to direct steam flow leaving through the main steam outlet back toward the first end of the header.

According to yet another aspect, the disclosure is directed to a humidification steam dispersion system comprising a steam header defining an interior and a steam exit point communicating with the interior for supplying humidification steam to the atmosphere and a hollow pipe positioned within the header interior, the hollow pipe defining a main humidification steam inlet and a main steam outlet, wherein the hollow pipe is configured to receive steam that flows through the pipe by entering the pipe through the main steam inlet and exiting the pipe through the main steam outlet into the header interior, wherein the main steam inlet and the main steam outlet face in the same direction.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
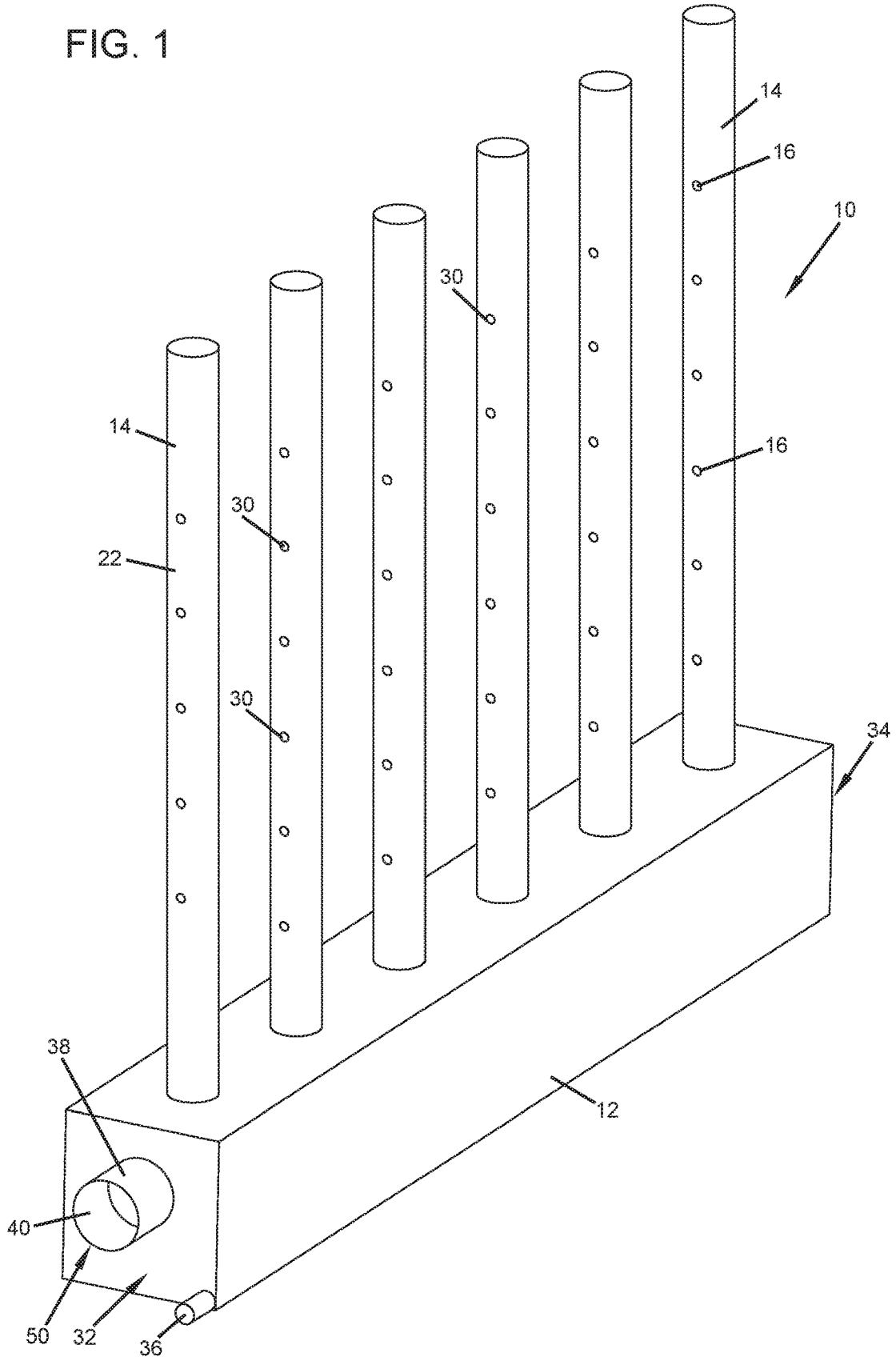
FIG. 1 is a perspective view of an example steam dispersion system having features that are examples of inventive aspects in accordance with the principles of the present disclosure.
Figure 2:
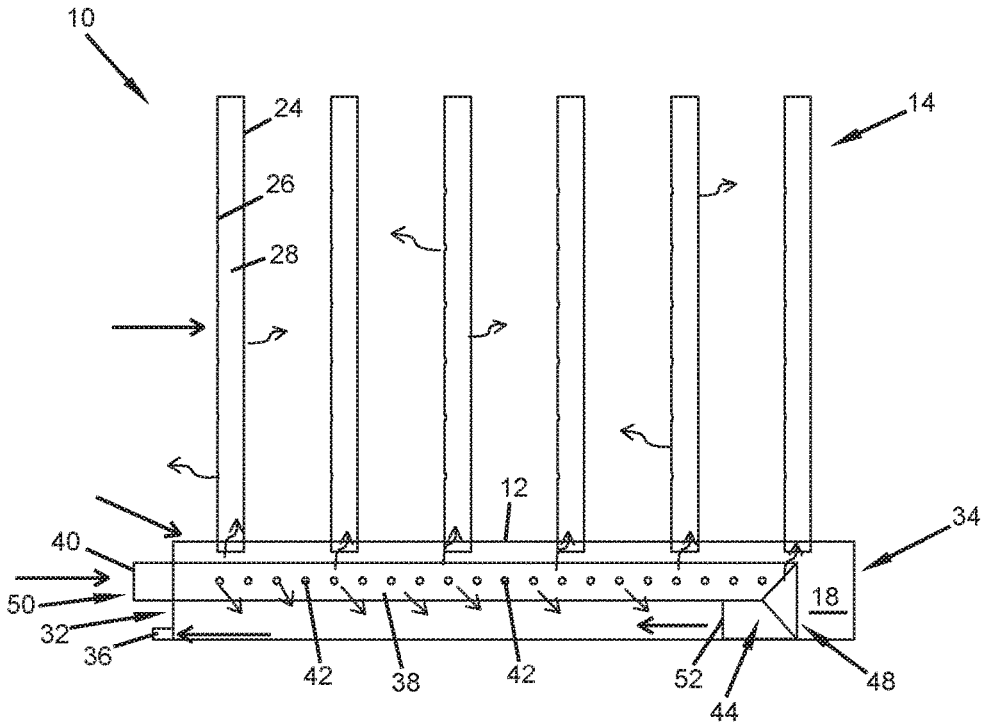
FIG. 2 is a diagrammatic side view of the steam dispersion system of FIG. 1 illustrating the internal features thereof.

A steam dispersion system 10 having features that are examples of inventive aspects in accordance with the principles of the present disclosure is illustrated in FIGS. 1-2. The steam dispersion system 10 generally includes a steam header 12 and a plurality of steam dispersion tubes 14 extending upwardly from the header 12. It should be noted that the steam dispersion system 10 illustrated in FIGS. 1-2 is simply one example in which the inventive aspects in accordance with the principles of the present disclosure can be used. Other systems are certainly possible.

As will be described in further detail below, the header 12 is configured to receive steam from a steam source, and the steam is dispersed into duct air through steam delivery points 16 of the steam dispersion tubes 14. The steam source may be a boiler or another source providing pressurized steam. The steam source provides pressurized steam towards the header 12. In the depicted example, each of the tubes 14 communicates with the header interior 18 for receiving pressurized steam. The steam tubes 14, in turn, disperse the steam to the atmosphere at atmospheric pressure. The header 12 is designed to distribute pressure evenly among the tubes 14 protruding therefrom.

In a system such as that illustrated in FIGS. 1-2, the steam supplied by the steam source is piped through the system 10 at a pressure generally higher than atmospheric pressure, which is normally the pressure at the point where the steam exits the tubes 14 and meets duct air. The pressure created by the flowing steam can be used for piping unwanted condensate 20 (see FIG. 3) from the system 10 as will be discussed in further detail below.

Still referring to FIGS. 1-2, each steam dispersion tube 14, as depicted, includes a generally cylindrical wall 22 defining an outer surface 24 and an inner surface 26. In other embodiments, the steam dispersion tubes 14 may be of other shapes, such as square, triangular, elliptical, etc. Also, in other embodiments, the steam dispersion tubes 14 may be formed from multiple pieces that are attached together to form the tubes 14. The steam dispersion tube 14 defines a hollow interior 28 for carrying steam. The steam dispersion tube 14 includes a plurality of openings 30 through the cylindrical wall 22 for emitting the steam. In certain embodiments, the outer surface 24 of the cylindrical wall 22 may be covered with insulation material. The insulation material may define a plurality of openings through the insulation that are aligned with the openings 30 of the steam dispersion tube 14.

The steam delivery points 16 of the steam dispersion tube 14 may be defined by nozzles (i.e., tubelets) provided in the openings 30. It should be noted that in other embodiments, the steam delivery points 16 may be defined simply by the openings 30 of the tubes 14 without the use of any nozzles. Each of the tubes 14 communicates with the header interior 18 for receiving and dispersing humidification steam to the atmosphere (e.g., to an air duct).

Still referring to FIGS. 1-2, the header 12 of the steam dispersion system 10 may be mounted via a frame structure (not shown) across an air duct for positioning the tubes 14 in the duct air flow.

The header 12 defines a first end 32 and a second end 34. The first end 32 includes a condensate drain opening 36 for allowing unwanted accumulated condensate to be drained from the system 10.

The header 12 receives the supply steam through a hollow structure or pipe 38 that extends within the header 12 in a direction generally extending from the first end 32 to the second end 34. The hollow pipe 38 defines a main steam inlet 40 at the first end 32 of the header 12, generally adjacent the same side as the condensate drain opening 36 of the system 10.

Supply steam is transported through the hollow pipe 38 towards the opposite second end 34 of the header from the first end 32 that has the main steam inlet 40.

As shown, the hollow pipe 38 includes orifices or openings 42 that penetrate the hollow structure or pipe 38 to allow some of the steam to exit to enhance uniform steam distribution within the header 12 and to control back pressure. The steam distributed through the orifices is used as humidification steam that enters the air duct through the tubes 14 extending from the header 12.

The hollow pipe 38, in the example depicted in FIGS. 1-2, is also utilized to pipe condensate toward the condensate drain 36 that is positioned at the same end 32 as the main steam inlet 40.

The depicted pipe 38 is configured to re-direct the pressurized steam approximately 180 degrees back towards the steam inlet end 32 of the header 12. The redirecting structure 44 can include a 180-degree u-bend of the pipe, two quantity 90-degree bends of the pipe, or multiple styles of deflecting shields or deflectors 46 provided within the header 12 that cooperate with the pipe 38 in re-directing the steam, as will be discussed in further detail below.

In the example shown in FIGS. 1-2, the steam redirecting structure 44 is in the form of a 180-degree bend of the hollow pipe 38 that is formed from two 90-degree bends positioned at an opposite second end 48 of the pipe 38 from the steam inlet end 50. In other example embodiments, the bend can be less than 180 degrees. Depending upon the configuration of the system 10, the bend can be provided at any angle greater than 90 degrees and less than or equal to 180 degrees. Pressurized steam flow exits the hollow pipe 38 at a main steam outlet opening 52 at the second end 48 that directs the steam toward the same end 32 as the condensate drain 36.

Figure 9:
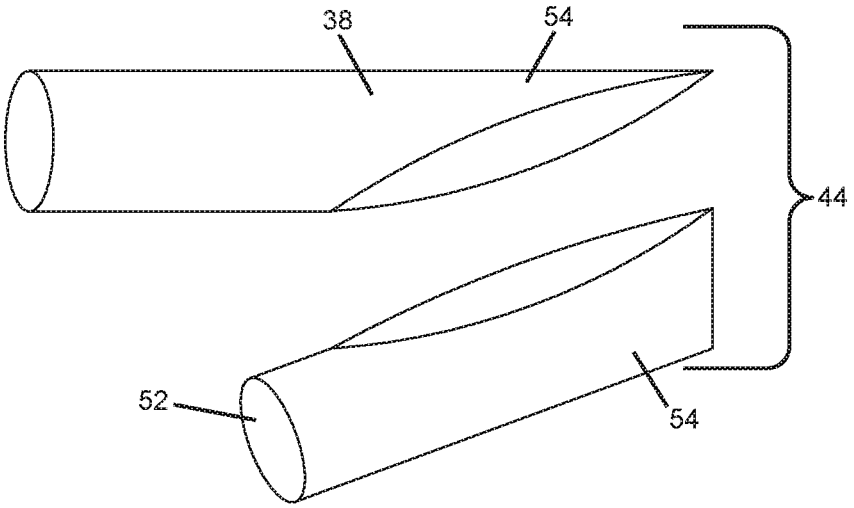
FIG. 9 illustrates two portions of the steam re-direction pipe that form the U-shaped bend in the system of FIG. 8, the two portions shown before attachment/welding thereof.
Figure 8:
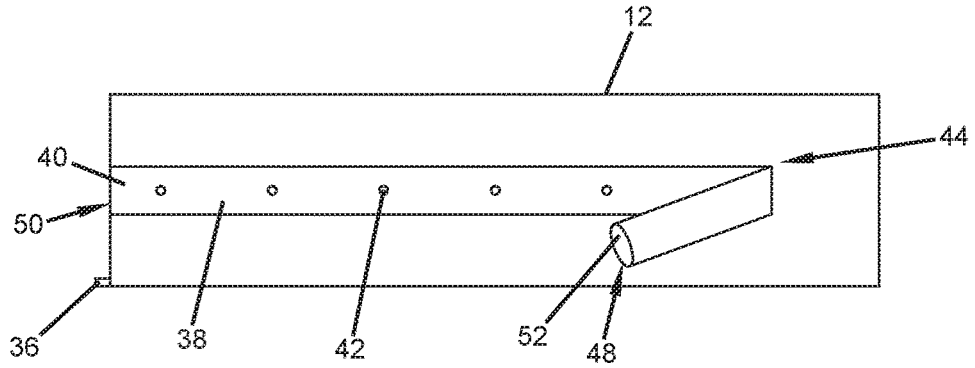
FIG. 8 is a diagrammatic side view of another version of the steam dispersion system of FIG. 1.

FIGS. 8-9 illustrate a 180-degree bend of the hollow pipe 38 that is formed from a 180-degree U-bend that is formed from two tube portions 54 that are cut at sharp angles that are welded together.

As noted above, the steam redirecting structure 44 can also include different styles of types of deflecting shields or deflectors 46 that cooperate with the hollow pipe 38 in re-directing steam flow toward the condensate drain 36.

Figure 3:
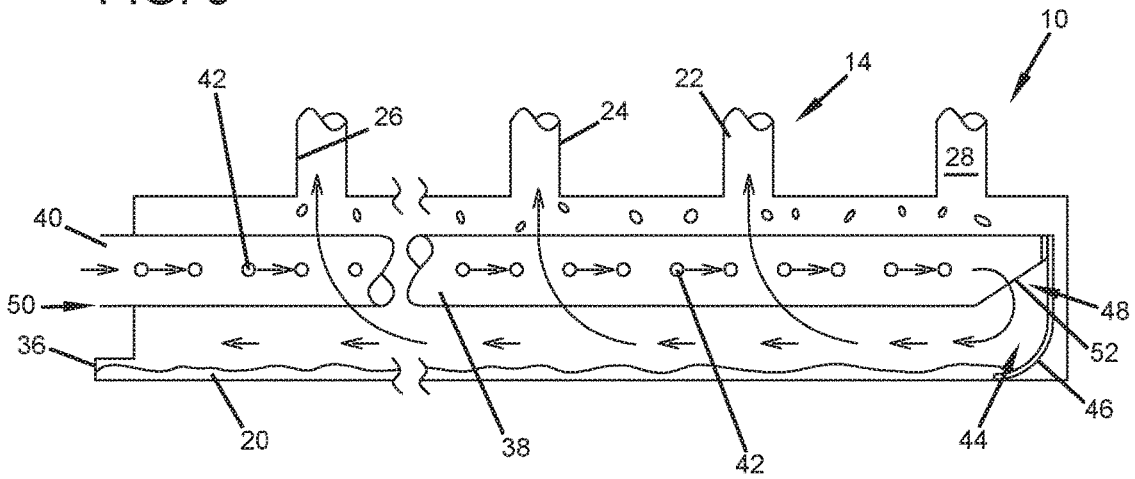
FIG. 3 is a diagrammatic side view of another version of the steam dispersion system of FIG. 1.
Figure 4:
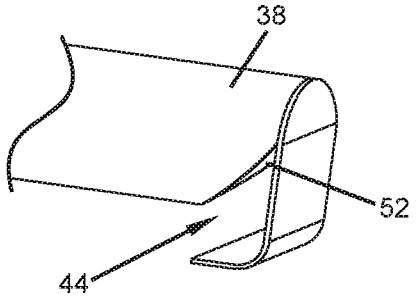
FIG. 4 is a perspective close-up view of the steam re-direction portion of the steam dispersion system of FIG. 3.

For example, in the depicted example of the system 10 in FIGS. 3 and 4, the steam redirecting structure 44 is provided by a combination of an angled outlet opening 52 at the second end 48 and a curved deflector 46 having a concave configuration for directing the steam flow towards the condensate drain 36.

Figure 5:
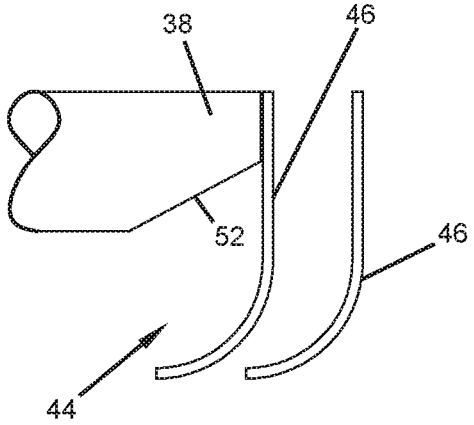
FIG. 5 is a diagrammatic side view of the steam re-direction portion of another version of the steam dispersion system of FIG. 1.

FIG. 5 illustrates an example of the system 10 with multiple such curved deflectors 46.

The second end 48 of the hollow pipe 38 that defines the main steam outlet/opening 52 can be cut at different angles and dimensions to control the opening 52 to allow optimum steam velocity hitting the deflector(s) 46 to create sufficient force to flow condensation toward the condensate drain 36. The angle and the size of the opening 52 can also be used to control the amount of backpressure to optimize the proper amount of steam dispersed through the orifices 42 along the length of the pipe.

Figure 6:
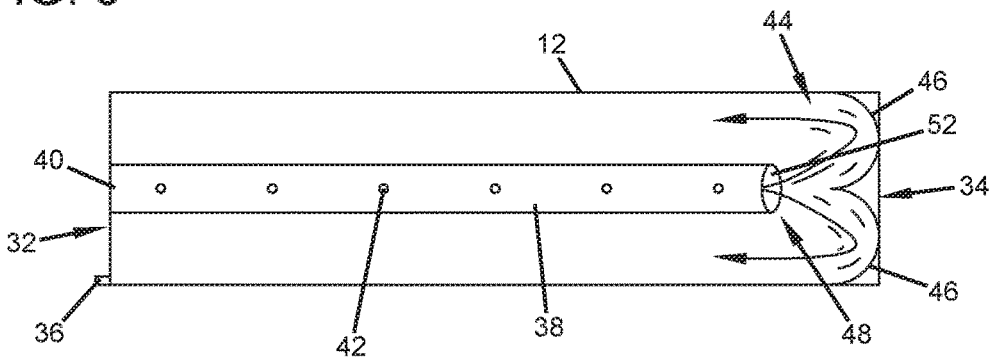
FIG. 6 is a diagrammatic side view of another version of the steam dispersion system of FIG. 1.

Referring now to FIG. 6, an example of the system 10 is illustrated wherein deflector(s) 46 positioned both partially below and above the hollow pipe 38 are used to redirect steam flow toward the condensate drain 36. The deflectors 46 are positioned at the second end 34 of the header 12 adjacent the main steam outlet 52 of the pipe 38. It should be noted that in the example of FIG. 6, the outlet opening 52 formed at the second end 48 of the pipe 38 is not angled and generally faces toward the second end 34 of the header 12. The deflectors 46 re-direct the steam flow back toward the condensate drain 36 from both above and below the hollow pipe 38 as shown.

Figure 7:
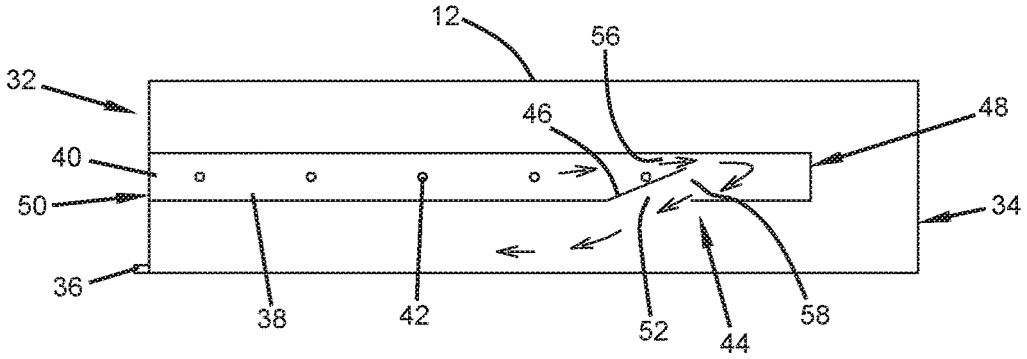
FIG. 7 is a diagrammatic side view of another version of the steam dispersion system of FIG. 1.

Another example of a deflector 46 in combination with the pipe 38 being used as a steam re-direction structure 44 is illustrated in FIG. 7. In the example depicted in FIG. 7, the hollow pipe 38 defines a sealed end 48 with an outlet opening 52 that is positioned generally at a bottom side of the pipe 38 at an intermediate location before the sealed end 48. The pipe 38 further includes a deflector 46 within the pipe 38 that splits the pipe 38 generally into two steam flow channels, a forward flow channel 56 and a rearward flow channel 58. The deflector 46 cooperates with the sealed end 48 and the bottom opening 52 of the pipe 38 in creating a generally circular clockwise flow pattern, as depicted, for the steam and directs the steam back through the rearward flow channel 58 and out the opening 52 toward the condensate drain 36.

The above specification, examples and data provide a complete description of the manufacture and use of the inventive aspects of the disclosure. Since many embodiments of the inventive aspects can be made without departing from the spirit and scope of the disclosure, the inventive aspects reside in the claims hereinafter appended.

We claim:

1. A humidification steam dispersion system comprising:

a steam header defining a first end and a second end;

a plurality of steam dispersion tubes extending from the header;

a condensate drain outlet located at the first end of the header;

a hollow pipe positioned within the header, the hollow pipe defining a length extending within the header in a direction generally from the first end to the second end, the hollow pipe defining a main humidification steam inlet located at the first end of the header and a main steam outlet within the header, wherein the hollow pipe is configured to receive steam that flows in from the main steam inlet toward the main steam outlet, the hollow pipe defining a plurality of orifices along the length thereof for allowing steam that is flowing through the hollow pipe to enter the header for distribution through the steam dispersion tubes; and a steam re-direction structure configured to direct steam flow leaving through the main steam outlet back toward the first end of the header, wherein the steam re-direction structure is defined by a bent portion of the hollow pipe that directs steam flow toward the first end of the header.

2. The humidification steam dispersion system of claim 1, wherein the bent portion of the hollow pipe defines a U-shaped bend that is greater than 90 degrees and less than or equal to 180 degrees.

3. The humidification steam dispersion system of claim 2, wherein the bent portion defines a 180-degree bend that comprises two 90-degree bends of the hollow pipe.

4. The humidification steam dispersion system of claim 1, wherein the main steam outlet is located at an end of the hollow pipe.

5. The humidification steam dispersion system of claim 1, wherein each steam dispersion tube defines a plurality of steam exit points.

6. A humidification steam dispersion system comprising:

a steam header defining a first end, a second end, and a steam exit point for supplying humidification steam to the atmosphere;

a condensate drain outlet located at the first end of the header;

a hollow pipe positioned within the header, the hollow pipe defining a length extending within the header in a direction generally from the first end to the second end, the hollow pipe defining a main humidification steam inlet located at the first end of the header and a main steam outlet within the header, wherein the hollow pipe is configured to receive steam that flows in from the main steam inlet toward the main steam outlet; and a steam re-direction structure configured to direct steam flow leaving through the main steam outlet back toward the first end of the header, wherein the steam re-direction structure is defined by a bent portion of the hollow pipe that directs steam flow toward the first end of the header.

7. The humidification steam dispersion system of claim 6, wherein the steam exit point is defined by at least one steam dispersion tube extending from the header.

8. The humidification steam dispersion system of claim 7, wherein the at least one steam dispersion tube includes a plurality of steam dispersion tubes extending upwardly from the header, each steam dispersion tube defining a plurality of steam dispersion openings.

9. The humidification steam dispersion system of claim 8, wherein the hollow pipe defines a plurality of orifices along the length thereof for allowing steam that is flowing through the hollow pipe to enter the header for distribution through the steam dispersion tubes.

10. The humidification steam dispersion system of claim 6, wherein the bent portion of the hollow pipe defines a U-shaped bend that is greater than 90 degrees and less than or equal to 180 degrees.

11. A humidification steam dispersion system comprising:

a steam header defining a first end and a second end;

a plurality of steam dispersion tubes extending from the header;

a condensate drain outlet located at the first end of the header;

a hollow pipe positioned within the header, the hollow pipe defining a length extending within the header in a direction generally from the first end to the second end, the hollow pipe defining a main humidification steam inlet located at the first end of the header and a main steam outlet within the header, wherein the hollow pipe is configured to receive steam that flows in from the main steam inlet toward the main steam outlet, the hollow pipe defining a plurality of orifices along the length thereof for allowing steam that is flowing through the hollow pipe to enter the header for distribution through the steam dispersion tubes; and a steam re-direction structure configured to direct steam flow leaving through the main steam outlet back toward the first end of the header, wherein the steam re-direction structure includes at least one deflection plate configured to deflect the steam flow exiting the main steam outlet toward the first end of the header, and wherein the main steam outlet is located at an intermediate position along the length of the hollow pipe with an end of the hollow pipe defining a sealed end.

12. A humidification steam dispersion system comprising:

a steam header defining a first end and a second end;

a plurality of steam dispersion tubes extending from the header;

a condensate drain outlet located at the first end of the header;

a hollow pipe positioned within the header, the hollow pipe defining a length extending within the header in a direction generally from the first end to the second end, the hollow pipe defining a main humidification steam inlet located at the first end of the header and a main steam outlet within the header, wherein the hollow pipe is configured to receive steam that flows in from the main steam inlet toward the main steam outlet, the hollow pipe defining a plurality of orifices along the length thereof for allowing steam that is flowing through the hollow pipe to enter the header for distribution through the steam dispersion tubes; and a steam re-direction structure configured to direct steam flow leaving through the main steam outlet back toward the first end of the header, wherein the steam re-direction structure includes at least one deflection plate configured to deflect the steam flow exiting the main steam outlet toward the first end of the header, and wherein the at least one deflection plate is located within the hollow pipe.

13. A humidification steam dispersion system comprising:

a steam header defining a first end, a second end, and a steam exit point for supplying humidification steam to the atmosphere;

a condensate drain outlet located at the first end of the header;

a hollow pipe positioned within the header, the hollow pipe defining a length extending within the header in a direction generally from the first end to the second end, the hollow pipe defining a main humidification steam inlet located at the first end of the header and a main steam outlet within the header, wherein the hollow pipe is configured to receive steam that flows in from the main steam inlet toward the main steam outlet; and a steam re-direction structure configured to direct steam flow leaving through the main steam outlet back toward the first end of the header, wherein the steam re-direction structure includes at least one deflection plate configured to deflect the steam flow exiting the main steam outlet toward the first end of the header, and wherein the main steam outlet is located at an intermediate position along the length of the hollow pipe with an end of the hollow pipe defining a sealed end, and wherein the at least one deflection plate is located within the hollow pipe.

* * * * *